US007529672B2

(12) United States Patent
Gigi

(10) Patent No.: US 7,529,672 B2
(45) Date of Patent: May 5, 2009

(54) SPEECH SYNTHESIS USING CONCATENATION OF SPEECH WAVEFORMS

(75) Inventor: Ercan Ferit Gigi, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 510 days.

(21) Appl. No.: 10/527,951

(22) PCT Filed: Aug. 8, 2003

(86) PCT No.: PCT/IB03/03624

§ 371 (c)(1),
(2), (4) Date: Mar. 15, 2005

(87) PCT Pub. No.: WO2004/027756

PCT Pub. Date: Apr. 1, 2004

(65) Prior Publication Data

US 2006/0059000 A1 Mar. 16, 2006

(30) Foreign Application Priority Data

Sep. 17, 2002 (EP) ..... 02078872

(51) Int. Cl.
*G10L 13/00* (2006.01)

(52) U.S. Cl. ..... 704/258; 704/260; 704/261; 704/264; 704/265; 704/267; 704/268

(58) Field of Classification Search ..... 704/258, 704/260, 261, 267, 264, 265, 268
See application file for complete search history.

(56) References Cited

U.S. PATENT DOCUMENTS 5,479,564 A 12/1995 Vogten et al.

6,067,519 A 5/2000 Lowry (Continued)

FOREIGN PATENT DOCUMENTS

EP 0363233 A1 4/1990

(Continued)

OTHER PUBLICATIONS

"Signal Processing X Theories and Applications"; Proceedings of Eusipco 2000, Tenth European Signal Processing Conference, Tampere, Finalnd, Sep. 4-8, 2000, vol. II of IV, Edited by Moncef Gabbouj and Pauli Kuosmanen.

(Continued)

*Primary Examiner*—Richemond Dorvil
*Assistant Examiner*—Natalie Lennox
(74) *Attorney, Agent, or Firm*—Michael E. Belk

(57) ABSTRACT

A method of synthesizing a speech signal by providing a first speech unit signal having an end interval and a second speech unit signal having a front interval, wherein at least some of the periods of the end interval are appended in inverted order at the end of the first speech unit signal in order to provide a fade-out interval, and at least some of the periods of the front interval are appended in inverted order at the beginning of the second speech unit signal to provide a fade-in interval. An overlap and add operation is performed on the end and fade-in intervals and the fade-out and front intervals.

14 Claims, 4 Drawing Sheets

U.S. PATENT DOCUMENTS

Figure 1:
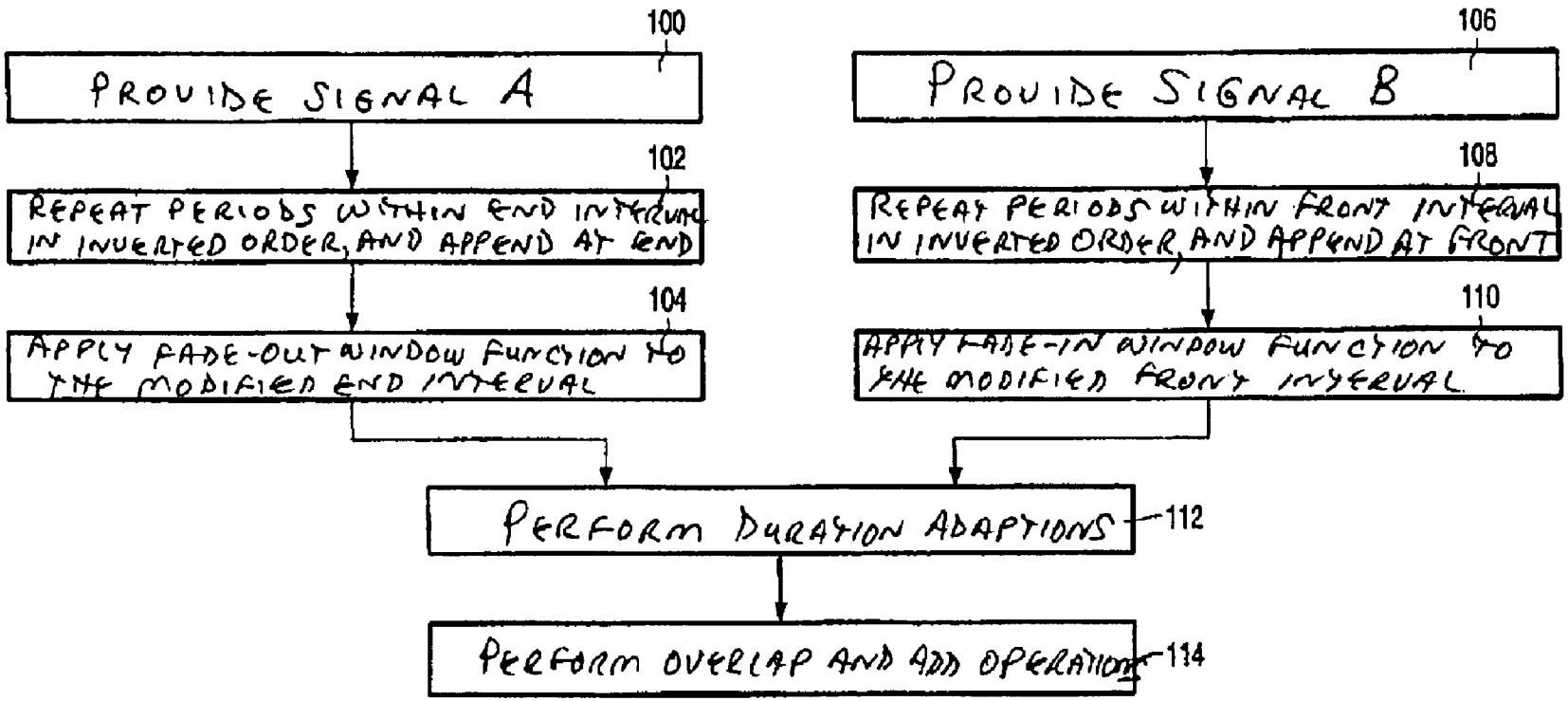

| | | | | |
|---|---|---|---|---|
| 6,665,641 | B1 * | 12/2003 | Coorman et al. | 704/260 |
| 2002/0143526 | A1 * | 10/2002 | Coorman et al. | 704/211 |

FOREIGN PATENT DOCUMENTS

| | | | |
|---|---|---|---|
| EP | 0427485 | A2 | 5/1991 |
| EP | 0706170 | A2 | 4/1996 |

OTHER PUBLICATIONS

Lee et al: "Improved Tone Concatenation Rules in a Formant$_{13}$ Based Chinese Text_to _Speech System"; IEEE Transactions on Speech and Audio Processing, vol. 1, No. , pp.

Moulines et al: "Pitch-Synchronous Waveform Processing Techniques for Text-to-Speech Synthesis Using Diphones"; Speech Commuication, Elsevier Science Publishers, Amsterdam, NL, vol. 9, No. 5/6, Dec. 1, 1990, pp. 453-467.

Matsui et al: "Improving Naturalness in Test-to-Speech Synthesis Using Natural Glottal Source"; Speech Processing 2, VLSI, Underwater Signal Processing, Toronto, May 14-17, 1991, International Conference on Acoustics, Speech and Signal Processing. ICASSP, New York. IEEE, vol. 2, Conference 16, Apr. 14, 1991, pp. 769-772.

Dutoit et al: "MBR-PSOLA: Text-to-Speech Synthesis Based on an MBE Re-Synthesis of Tthe Segments Database"; Speech Communication, Elsevier Publisher, Nov. 1993, vol. 13, N. Degree, 3-4.

* cited by examiner $P'_1 = P_N$
$P'_2 = P_{N-1}$
...
$P'_M = P_2$
$P'_j = P_{N-j+1}$ $P'_1 = P_{N-1}$
$P'_2 = P_{N-2}$
...
$P'_M = P_1$
$P'_j = P_{N-j}$

SPEECH SYNTHESIS USING CONCATENATION OF SPEECH WAVEFORMS

Present invention relates to the field of synthesizing of speech or music, and more particularly without limitation, to the field of text-to-speech synthesis.

The function of a text-to-speech (TTS) synthesis system is to synthesize speech from a generic text in a given language. Nowadays, TTS systems have been put into practical operation for many applications, such as access to databases through the telephone network or aid to handicapped people. One method to synthesize speech is by concatenating elements of a recorded set of subunits of speech such as demi-syllables or polyphones. The majority of successful commercial systems employ the concatenation of polyphones.

The polyphones comprise groups of two (diphones), three (triphones) or more phones and may be determined from nonsense words, by segmenting the desired grouping of phones at stable spectral regions. In a concatenation based synthesis, the conversation of the transition between two adjacent phones is crucial to assure the quality of the synthesized speech. With the choice of polyphones as the basic subunits, the transition between two adjacent phones is preserved in the recorded subunits, and the concatenation is carried out between similar phones.

Before the synthesis, however, the phones must have their duration and pitch modified in order to fulfill the prosodic constraints of the new words containing those phones. This processing is necessary to avoid the production of a monotonous sounding synthesized speech. In a TTS system, this function is performed by a prosodic module. To allow the duration and pitch modifications in the recorded subunits, many concatenation based TTS systems employ the time-domain pitch-synchronous overlap-add (TD-PSOLA) (E. Moulines and F. Charpentier, "Pitch synchronous waveform processing techniques for text-to-speech synthesis using diphones," Speech Commun., vol. 9, pp. 453-467, 1990) model of synthesis.

In the TD-PSOLA model, the speech signal is first submitted to a pitch marking algorithm. This algorithm assigns marks at the peaks of the signal in the voiced segments and assigns marks 10 ms apart in the unvoiced segments. The synthesis is made by a superposition of Hanning windowed segments centered at the pitch marks and extending from the previous pitch mark to the next one. The duration modification is provided by deleting or replicating some of the windowed segments. The pitch period modification, on the other hand, is provided by increasing or decreasing the superposition between windowed segments.

Despite the success achieved in many commercial TTS systems, the synthetic speech produced by using the TD-PSOLA model of synthesis can present some drawbacks, mainly under large prosodic variations.

Example of such PSOLA methods are those defined in documents EP-0363233, U.S. Pat. No. 5,479,564, EP-0706170. A specific example is also the MBR-PSOLA method as published by T. Dutoit and H. Leich, in Speech Communication, Elsevier Publisher, November 1993, vol. 13, N. degree. 3-4, 1993. The method described in document U.S. Pat. No. 5,479,564 suggests a means of modifying the frequency by overlap-adding short-term signals extracted from this signal. The length of the weighting windows used to obtain the short-term signals is approximately equal to two times the period of the audio signal and their position within the period can be set to any value (provided the time shift between successive windows is equal to the period of the audio signal). Document U.S. Pat. No. 5,479,564 also describes a means of interpolating waveforms between segments to concatenate, so as to smooth out discontinuities. In prior art text-to-speech systems a set of pre-recorded speech fragments can be concatenated in a specific order to convert a certain text into natural sounding speech. Text-to-speech systems that use small speech fragments have many such concatenation points. Especially when the speech fragments are spectrally different, these joins produce artifacts that reduce the intelligibility. In particular, when two speech segments from different recording times are to be concatenated, the resulting speech can have a discontinuity at the joint of the two segments. For example, when a vowel is synthesized, the left part mostly comes from a different recording than the right part. This makes it impossible to reproduce the exact color of a vowel.

The slight differences in the formant trajectories produce a sudden jump at the joint location. What is mostly done in the prior art to reduce this effect is to re-record the speech fragment until it matches with the rest or add different versions (extra fragments) to minimize the difference.

The present invention therefore aims to provide an improved method of synthesizing of a speech signal, the speech signal having at least a first diphone and a second diphone. The present invention further aims to provide a corresponding computer program product and computer system, in particular text-to-speech system.

The present invention provides for a method of synthesizing of speech signal based on first and second diphone signals which are superposed at their joint. The invention enables a smooth concatenation of the diphone signals without any audible artifacts. This is accomplished by appending periods of an end interval of the first diphone signal in inverted order at the end of the first diphone signal and by appending periods of a front interval of the second diphone signal at the beginning of the second diphone signal. The end and front intervals are overlapped to produce the smooth transition.

In accordance with an embodiment of the invention the end and front intervals of the first and second diphone signal are identified by a marker. Preferably the end and front intervals contain periods which are about steady, i.e. which have approximately the same information content and signal form. Such end and front intervals can be identified by a human expert or by means of a corresponding computer program. Preferably the first analysis is performed by means of a computer program and the result if reviewed by a human expert for increased precision.

In accordance with a further embodiment of the invention the last period of the end interval and the first period of the front interval are not appended. This has the advantage that no periodicity is introduced into the signal by the immediate repetition of two identical periods.

In accordance with a further embodiment of the invention a windowing operation is performed on the end and front intervals as well as on the respective appended periods by means of fade-out and fade-in windows, respectively. Preferably a raised cosine window function is used for voiced end intervals and the appended periods, whereas for unvoiced end intervals and the appended periods a sine window is used as a fade-out window. Likewise a raised cosine is used as a window function for smoothening the beginning of a voiced segment of the second diphone or a sine window for unvoiced segments.

In accordance with an embodiment of the invention a duration adaptation is performed for the intervals to be overlapped. Especially if the intervals have different durations this is advantageous in order to avoid the introduction of abrupt signal transitions.

In accordance with a further embodiment of the invention, text-to-speech processing is performed by concatenating diphones in accordance with the principles of the present invention. This way a natural sounding speech output can be produced.

It is important to note that the present invention is not restricted to the concatenation of diphones but can also be advantageously employed for the concatenation of other speech units such as triphones, polyphones or words.

Figure 2:
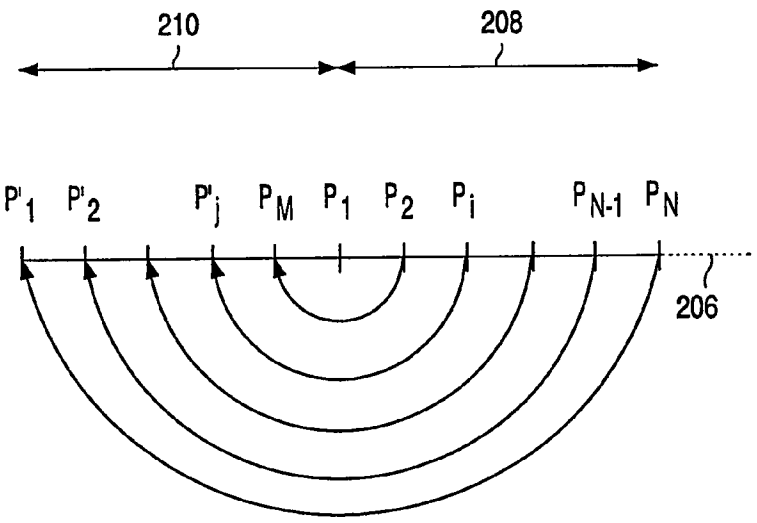
Figure 2:
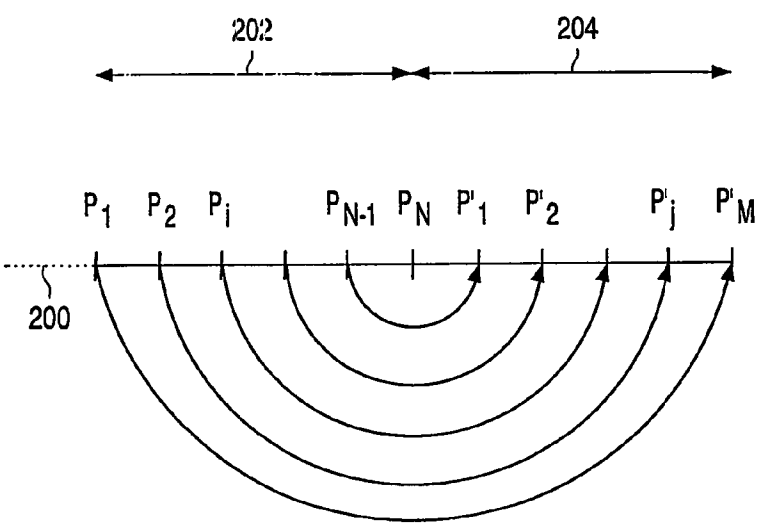
Figure 3:
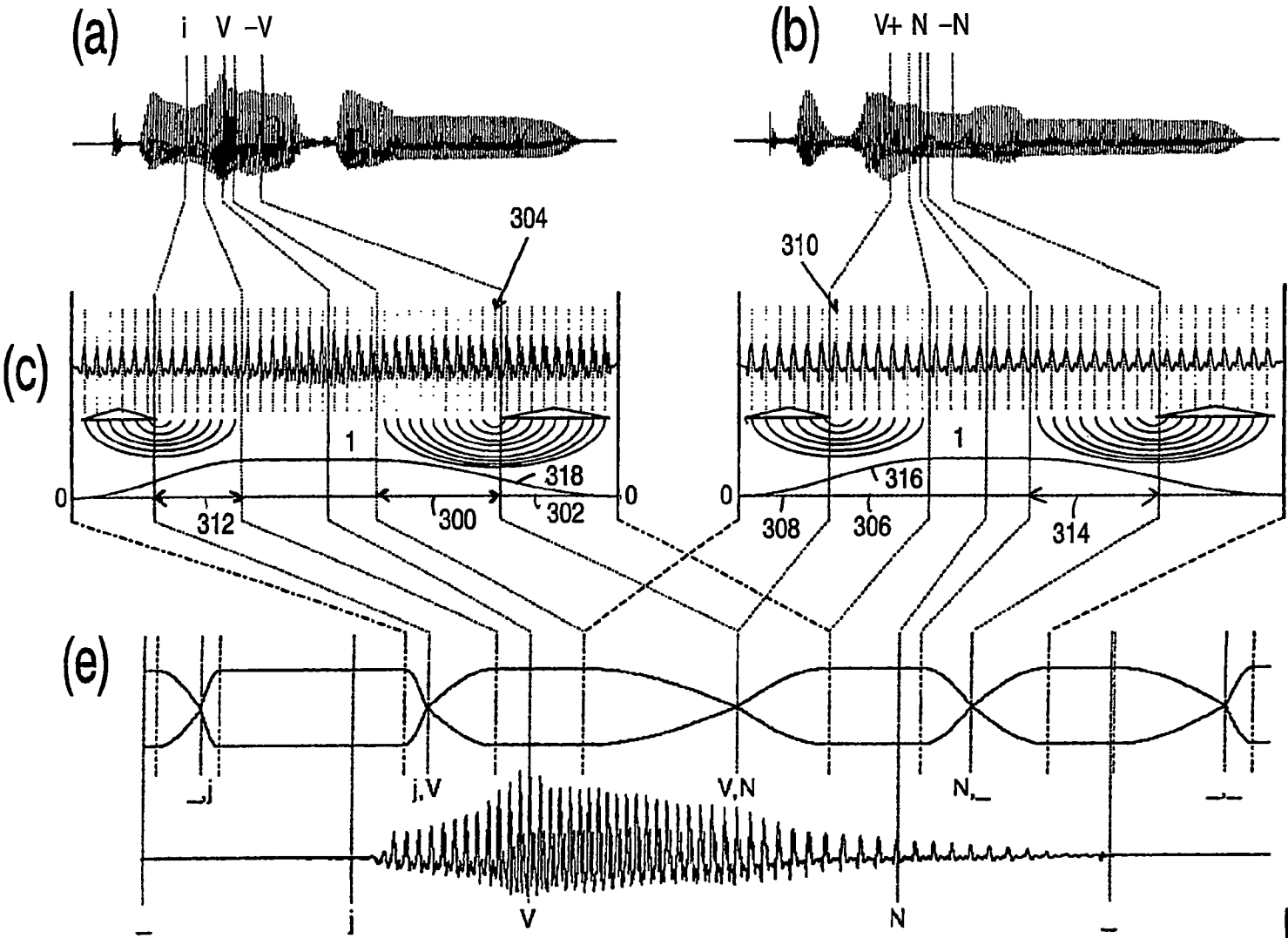
Figure 4:
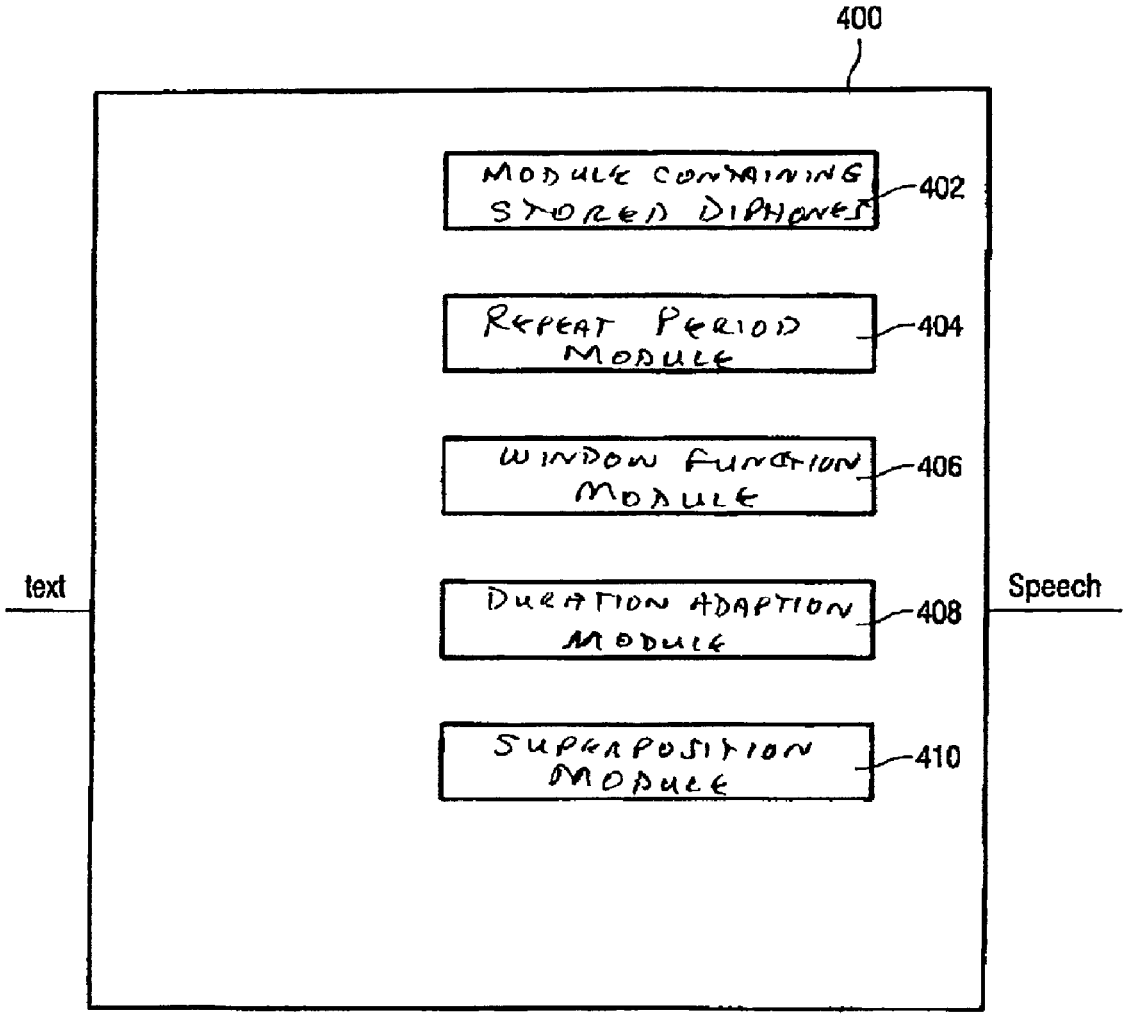

In the following embodiments of the invention are described in greater detail by making reference to the drawings in which:

FIG. 1 depicts a flow chart of a preferred embodiment of a method of the invention, FIG. 2 depicts the interleaved repetition of periods at the end and the front of the original diphone signals, FIG. 3 depicts an example for a signal synthesis, and FIG. 4 depicts a block diagram of an embodiment of a text-to-speech system.

FIG. 1 shows a flow diagram which illustrates a preferred embodiment of a method of the present invention. In step 100 a first diphone signal A is provided. The diphone signal A has at least one marker which identifies an end interval of the diphone A signal.

In step 102 periods within the end interval of the diphone signal A are repeated in inverted order in order to provide a fade-out interval which is appended at the end of the end interval. In step 104 the end interval with its' appended fade-out interval are windowed by means of a fade-out window function in order to smoothly fade out the diphone signal at its' end. Likewise a diphone signal B is provided in step 106. The diphone signal B has at least one associated marker in order to identify a front segment of the diphone signal B. In step 108 at least some of the front intervals periods are appended at the beginning of the front interval of the diphone signal B in inverted order. This way a fade-in interval is provided. In step 110 the front interval and the appended fade-in interval are windowed by means of a fade-in window. This way a smooth beginning of the diphone signal B is provided. In step 112 a duration adaptation is performed. This means that the durations of the end and front intervals of the diphone signals A and B are modified such that the end and fade-in intervals have the same duration. Likewise the durations of the fade-out and front intervals are adapted. In step 114 an overlap and add operation is performed on the diphone signals A and B with the processed end and fade-in intervals and the fade-out and front intervals. This way a smooth concatenation of the diphone signals A and B is accomplished. For voiced segments usage of the following raised cosine window function is preferred:

$$w[n] = 0.5 - 0.5 \cdot \cos\left(\frac{\pi \cdot (n + 0.5)}{m}\right),\ 0 \le n < m$$

where m is the total number of periods in the smoothing range.

For unvoiced segments, a sine window is used:

$$w[n] = \sin\left(\frac{0.5 \cdot \pi \cdot (n + 0.5)}{m}\right),\ 0 \le n < m$$

The advantage of using a sine-window is that this ensures that the total signal envelope in power-domain remains constant. Unlike a periodic signal, when two noise samples are added, the total sum can be smaller than the absolute value of any of the two samples. This is because the signals are (mostly) not in-phase. The sine-window adjusts for this effect and removes the envelope-modulation.

FIG. 2 illustrates the process of appending interval periods in inverted order (cf. steps 102 and 108 of FIG. 1). Time axis 200 illustrates the time domain of diphone signal A. The diphone signal A has an end interval 202 which contains periods $p_1, p_2, \ldots, P_i, \ldots, P_{N-1}, P_N$. In order to provide fade-out interval 204 periods $p_i$ of the end interval 202 are appended at the end of the end interval 202 in inverted order. The last period $P_N$ of the end interval 202 is not appended in order to avoid a repetition of two identical periods which would introduce an unintended periodicity. Such a periodicity could become audible under certain circumstances. It is therefore preferred not to repeat the least period $P_N$ of the end interval 202. The first period $p'_1$ of the fade-out interval 204 is provided by copying the signal of period $P_{N-1}$. In general, period $p'_j$ of fade-out interval 204 is obtained by appending period $P_{N-j}$ from the end interval 202, i.e. $p'_j = p_{N-j}$. Time axis 206 is illustrative of the time domain of diphone signal B. Diphone signal B has a front interval 208 containing periods $P_1, P_2, \ldots, P_i, \ldots, P_{N-1}, P_N$. Fade-in interval 210 is provided by appending periods from front interval 208 at the beginning of front interval 208 in inverted order. Again it is preferred not to append the first period $P_1$ of the front interval 208 to avoid the introduction of unintended periodicity. In the general case a signal period $P'_j$ is obtained from the period $P_{N-j+1}$ of the front interval 208, i.e. $P'_j = P_{N-j+1}$ For concatenating the diphone signal A and the diphone signal B, the end interval 202 and the fade-in interval 210 are overlapped and added as well as the fade-out interval 204 and front interval 208. In the example considered here this can be done without adapting the durations of the respective intervals, as the durations of the end interval 202 and the fade-in interval 210 as well as the durations of the fade-out interval 204 and the front interval 208 are the same.

FIG. 3 shows an example for the various synthesis steps for the word 'young'. This word is made of the phonemes /j/, /V/, /N/ and the silence /_/.a) and b) are the recorded nonsense words that contain the transitions from /j/ to /V/ and /V/ to /N/. Within each nonsense word five markers are placed. The outer markers are the diphone borders (labels j-, -V, V- and -N). The markers in the middle show where a new phoneme starts (labels V, and N). The other labels are used to mark the segments that will be used for overlap-add. As it is illustrated in the diagram (c) of FIG. 3 the periods of the end interval 300 are repeated in inverted order to provide a fade-out interval 302. All the periods within end interval 300 are appended after period 304 which is the last period of the end interval 300. Period 304 itself is not appended to avoid the repetition of the same period which would introduce an unintended periodicity. Likewise for the diphone signal of diagram (b) of FIG. 3 the periods within front interval 306 are appended at the beginning of the front interval 306 in inverted order. This applies for all of the period within the front interval 306 except the first period 310 at the beginning of the front interval 306. Again this period 310 is not appended in order to avoid two consecutive identical periods which would introduce an unintended periodicity. The same kind of processing is done for the front interval 312 of the diphone signal of the diagram (a) and for the end interval 314 of the diphone signal of diagram (b). Further the same approach is applied to the further diphones which are required to be concatenated for the synthesis of the word 'young'. Next a smoothening window is applied to the front, end, fade-in and fade-out intervals. For voiced segments a raised cosine is preferably used as a window function. The following window function is employed for the fade-in and front intervals:

$$w[n] = 0.5 - 0.5 \cdot \cos\left(\frac{\pi \cdot (n + 0.5)}{m}\right), 0 \le n < m$$

where m is the total number of periods in the smoothening range. The corresponding raised cosine is shown as raised cosine 316 in diagram (d). A corresponding window function is used to provide raised cosine 318 for the end and fade-out intervals 300 and 302. As it is illustrated in the diagram (e) the durations of the intervals to be overlapped and added, i.e. intervals 300/308 and intervals 302/306 are rescaled in order to bring them to an equal length. The following superposition of the required diphone provides the synthesis of the word 'young'.

FIG. 4 shows a block diagram of computer system 400, which is a text-to-speech system. The computer system 400 has module 402 which serves to store diphones and markers for the diphones to indicate front and end intervals. Module 404 serves to repeat periods contained in the end and front intervals in inverted order in order to provide fade-in and fade-out intervals. Module 406 serves to provide a window function for windowing the end/fade-out and fade-in/front intervals for the purposes of smoothening. Module 408 serves for duration adaptation of the intervals to be superposed. Such a duration adaptation is required if the intervals to be superposed are not of equal length. Module 410 serves for the superposition of the end/fade-in and of the fade-out/front intervals in order to concatenate their required diphones. When text is entered into the computer system 400 the required diphones to be concatenated are selected from module 402. These diphones are processed by means of modules 404, 406 and 408 before they are overlapped and added by means of module 410, which results in the required synthesized speech signal.

The invention claimed is:

1. A method of synthesizing of a speech signal, the speech signal having at least a first speech unit and a second speech unit, the method comprising the steps of:

providing a first speech unit signal, the first speech unit signal having an end interval, providing a second speech unit signal, the second speech unit signal having a front interval, appending of at least some periods of the end interval in inverted order at the end of the first speech unit signal to provide a fade-out interval, appending of at least some periods of the front interval in inverted order at the beginning of the second speech unit signal to provide a fade-in interval, superposing of the end and fade-in intervals and of the fade-out and front intervals.

2. The method of claim 1, whereby the end and front intervals have approximately steady periods.

3. The method of claim 1 or 2, the end and front intervals being identified by a marker.

4. The method of claim 1, whereby the last period of the end interval and the first period of the front interval are not appended.

5. The method of claim 1, further comprising windowing of the end and/or fade-out intervals with a fade-out window.

6. The method of claim 5, whereby a raised cosine is used as a fade-out window.

7. The method of claim 6, whereby the following window function is used for voiced intervals:

where m is the total number of periods in a smoothening range $$w[n] = 0.5 - 0.5 \cdot \cos\left(\frac{\pi \cdot (n + 0.5)}{m}\right), 0 \le n < m.$$

8. The method of claim 5, whereby a sine window is used as a fade-out window for unvoiced intervals.

9. The method of claim 8, whereby the following window function is used:

$$w[n] = \sin\left(\frac{0.5 \cdot \pi \cdot (n + 0.5)}{m}\right), 0 \le n < m \tag{2.7}$$

where m is the total number of periods in a smoothening range.

10. The method of claim 1, the first and second speech units being diphones and/or triphones and/or polyphones, in particular words.

11. The method of claim 1, further comprising adapting the durations of the end and fade-in intervals and of the fade-out and front intervals.

12. The method of claim 1, whereby the speech signal is synthesized by means of an overlap and add operation.

13. Computer digital storage medium, comprising program means for synthesizing of a speech signal, the speech signal having at least a first speech unit and a second speech unit, the program means being adapted to perform the steps of:

providing a first speech unit signal, the first speech unit signal having an end interval, providing a second speech unit signal, the second speech unit signal having a front interval, appending of at least some periods of the end interval in inverted order at the end of the first speech unit signal to provide a fade-out interval, appending of at least some periods of the front interval in inverted order at the beginning of the second speech unit signal to provide a fade-in interval, superposing of the end and fade-in intervals and of the fade-out and front intervals.

14. Computer system, in particular text-to-speech system, for synthesizing of a speech signal, the speech signal having at least a first speech unit and a second speech unit, the computer system comprising:

means (402) for storing of a first speech unit signal, the first speech unit signal having an end interval, and for storing of a second speech unit signal, the second speech unit signal having a front interval, means (404) for appending of at least some periods of the end interval (202; 300) in inverted order at the end of the first speech unit signal to provide a fade-out interval (204; 302), means (404) for appending of at least some periods of the front interval (208; 306) in inverted order at the beginning of the second speech unit signal to provide a fade-in interval (308), means (410) for superposing of the end and fade-in intervals and of the fade-out and front intervals.

* * * * *